United States Patent [19]

Anzenberger, Sr.

[11] Patent Number: 4,604,227

[45] Date of Patent: Aug. 5, 1986

[54] VAPOR PHASE AND SURFACE CONTACT RUST PREVENTIVE COMPOSITION

[75] Inventor: Joseph F. Anzenberger, Sr., New City, N.Y.

[73] Assignee: Stauffer Chemical Company, Westport, Conn.

[21] Appl. No.: 672,043

[22] Filed: Nov. 16, 1984

[51] Int. Cl.[4] ..... C09K 3/00; C23F 11/02; C23F 11/16

[52] U.S. Cl. ..... 252/389.2; 252/33.4; 252/389.61; 252/392

[58] Field of Search ..... 422/9, 10; 252/33.4, 252/389.2, 392, 389.61

[56] References Cited

U.S. PATENT DOCUMENTS

| | | | |
|---|---|---|---|
| 2,845,328 | 7/1958 | Fleishhacker | 422/9 |
| 3,672,822 | 6/1972 | Vedder et al. | 422/9 |
| 3,967,926 | 7/1976 | Rozenfeld et al. | 422/9 |
| 4,074,013 | 2/1978 | Koch et al. | 252/392 X |
| 4,101,431 | 7/1978 | Kuntschik | 252/389.2 X |
| 4,116,701 | 9/1978 | Conner, Sr. | 422/9 X |
| 4,263,062 | 4/1981 | Anzenberger | 252/389.2 X |
| 4,486,324 | 12/1984 | Korosec | 252/33.4 X |

OTHER PUBLICATIONS

Evans, U. R., *The Corrosion and Oxidation of Metals: Scientific Principles and Practical Applications,* Edward Arnold Pubshrs., London, (1967), pp. 531–532.

*The Merck Index,* Eighth Ed., Merck & Co., Rahway, NJ, (1968), p. 680.

*The Condensed Chemical Dictionary,* Ninth Ed., Van Nostrand Reinhold Co., (1977), p. 286.

*Primary Examiner*—John F. Terapane
*Assistant Examiner*—Matthew A. Thexton
*Attorney, Agent, or Firm*—Roger S. Benjamin

[57] ABSTRACT

A rust preventive composition effective in protecting metal surfaces by direct or vapor phase contact contains as essential ingredients: (A) an aryl phosphate; (B) a polyolester; (C) a calcium petroleum sulfonate; and (D) an alkylamine alkanol.

2 Claims, No Drawings

VAPOR PHASE AND SURFACE CONTACT RUST PREVENTIVE COMPOSITION

BACKGROUND OF THE INVENTION

Phosphate esters are finding increasing use as fire resistant lubricating and hydraulic fluids. These ester lubricants have the desirable properties of low flammability, high lubricity, and long service life.

New machinery or machinery in storage or transport is sometimes rustproofed with conventional petroleum based compositions or other formulations which are not compatible with phosphate esters. The use of these petroleum based products often necessitates an extensive cleaning before machinery may be operated with phosphate ester fluids.

An important use of rust preventive compositions is in machinery which is in storage or is inactivated for servicing. U.S. Pat. No. 4,263,062 describes a phosphate ester based composition effective in preventing corrosion where the composition contacts metal surfaces.

A shortcoming of the rust preventive composition of U.S. Pat. No. 4,236,062 is that it exhibits its rust preventive properties only when in contact with metal surfaces. Unfortunately, machinery in storage or disuse may have many internal areas that do not permit inspection or access and where the rust preventive fluid has drained off or failed to make contact.

SUMMARY OF THE INVENTION

This invention is a rust-preventive composition which produces its desirable effects when the composition is in contact with a metal surface and also when the vapor phase of the composition is in contact with a metal surface.

The composition of the present invention contains as essential ingredients: (1) aryl phosphate ester; (2) an oil-soluble calcium sulfonate; (3) a liquid polyolester; and (4) an alkylamino alkanol.

The present invention is also a concentrate for imparting rust preventive properties to phosphate ester basestocks.

It is a further object of this invention to provide a method of preventing corrosion of metal surfaces by placing said surfaces in contact with the vapor phase of the composition of this invention.

DETAILED DESCRIPTION OF THE INVENTION

The first essential component of the rust-preventive composition of this invention is a liquid aryl phosphate ester.

Suitable aryl phosphate esters are represented by the formula:

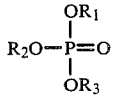

wherein $R_1$, $R_2$, and $R_3$ are the same or different and are selected from aryl, alkaryl, alkyl, aralkyl or cycloalkyl radicals having one to about thirty carbon atoms; with the proviso that at least one of $R_1$, $R_2$, $R_3$, is aryl or alkaryl. Most preferred are triaryl phosphates wherein $R_1$, $R_2$, or $R_3$ are all aryl or alkaryl radicals. Examples of suitable triaryl phosphates are triphenyl phosphate, tricresyl phosphate, trixylyl phosphate, cresyl diphenyl phosphate, isopropylphenyl diphenyl phosphate, di-isopropylphenyl/diphenyl phosphate, tertiary-butylphenyl/diphenyl phosphate or ditertiarybutylphenyl/diphenyl phosphate. A mixture of phosphate esters may be used if desired. The aryl phosphate ester component constitutes about 50 to about 95 weight percent of the rust inhibiting composition. Preferably, the aryl phosphate ester constitutes from 65 to 90 weight percent of the rust preventive composition.

The second essential ingredient in the rust-preventive composition is an oil-soluble calcium sulfonate.

Oil-soluble calcium sulfonates are detergent additives having a molecular weight of from about 350 to about 550. These sulfonates are formed by reacting petroleum sulfonic acid with a 10 to 100 percent excess of calcium carbonate or calcium hydroxide neutralizing agent. The oil-soluble calcium sulfonate ingredient should constitute from about 0.1 to about 3.0 weight percent of the rust-preventive composition.

The third essential ingredient of the rust-preventive composition is a liquid polyolester having a viscosity of 4.30 cSt to 4170 cSt at 100° C. The polyolester is the reaction product of a polyhydric alcohol and a monocarboxylic acid. Examples of suitable polyhydric alcohols are ethylene glycol, propylene glycol, neopentylene glycol, trimethylolpropane, pentaerythritol, or dipentaerythritol. Mixtures of polyols may be used if desired. Examples of suitable monocarboxylic acids are straight or branched chain acids of at least eight carbon atoms such as octanoic acid, decanoic acid, stearic acid, and 2-ethyl hexanoic acid. Mixtures of acids may be used if desired. A preferred polyolester is the reaction product of pentaerythritol with butyric and heptanoic acids.

The liquid polyolester ingredient constitutes from about 5 to about 30 weight percent of the rust-preventive composition. Preferably, the proportion of liquid polyolester is from about 20 to about 30 weight percent of the composition.

The alkylaminoalkanol ingredient is an alkylamino alkanol having sufficient volatility to be present in the vapor phase above the rust preventive composition in a rust preventive concentration. Generally, alkylamino alkanols having 3 to 8 carbon atoms are suitable. Specific examples of alkylaminoslkanols having utility in the invention are N-methylethanol amine, diethylamino ethanol, or mixtures thereof. It is present at 0.3–3% of the composition.

The four essential ingredients described above are mixed to form a single phase. The essential ingredients should comprise in combination at least about 80 weight percent of the rust preventive composition. The balance of the composition may, if desired, include minor amounts of optional ingredients such as dyes, or diluents. Any optional ingredients should be completely miscible with the mixture of essential ingredients of this invention.

This invention is a rust preventive concentrate for phosphate ester basestock fluids. The essential ingredients of the concentrate are: (1) an oil soluble calcium petroleum sulfonate ingredient; (2) a liquid polyolester ingredient and (3) a vapor phase corrosion inhibiting amount of alkanolamine.

The concentrate generally comprises from about 1.0 to about 5.0 weight percent of oil soluble calcium petroleum sulfonate ingredient; about 60 to about 95 weight percent liquid polyolester ingredient; and about 5.0 to about 10.0 weight percent of alkanol amine.

The concentrate is used by mixing it with phosphate ester basestock functional fluids to form the rust preventive composition of the invention described above. A particularly useful method of employing the concentrate of the invention is to add the concentrate to phosphate ester lubricant inside the sump of a machine. The concentrate enhanced fluid is then circulated inside the machine prior to storage to effect mixing. The proportion of concentrate to phosphate ester basestock is typically from about 10:90 to about 15:85.

Metal surfaces (especially, ferrous metal surfaces) are protected from corrosion by at least one of two application methods. First, the composition may be contacted with the surface to be corrosion protected. The composition may be applied by any conventional means such as spraying, dipping, brushing, flushing, etc. Since the rust-preventive composition has the ability to adhere to metal surfaces, it is only necessary to contact the metal with the composition to deposit a rust-preventive effective coating. Second, the rust preventive composition of the invention is placed adjacent to the metal surface to be protected so that the metal surface comes in contact with the vapor phase of the composition. Generally, the composition of the invention is in an enclosed airspace such as the inside of a machine so that there is not a significant loss of alkylaminoalkanol. The vapor from the composition of the invention exerts a rust preventive effect on metal surfaces.

The following Examples illustrate the formulation and manner of use of the composition of the invention.

EXAMPLE 1

A rust preventive concentrate for phosphate esters was prepared by dissolving calcium petroleum sulfonate in polyolester at 54.4° C. then cooling to room temperature before blending in N-methyl ethanol amine. The mixture was clear at room temperture and also at 16.7° C. The foregoing concentrate was added to tertiarybutylphenyl/phenyl phosphate and mixed at 54.4° C. for 30 minutes. The complete composition appeared to having a slight haze but there was no phase separation.

| PROPORTIONS FOR COMPOSITION | | |
|---|---|---|
| Ingredient | Grams | Weight Percent |
| Polyolester (Uniflex 202) | 100 | 10.0 |
| Calcium petroleum sulfonate (Witco 25H) | 2.5 | 0.25 |
| N—methyl ethanolamine | 10.0 | 1.0 |
| t-butylphenyl/phenyl phosphate (Fyrquel 150) | 887.5 | 88.75 |
| Total | | 100% |

Test Results:

The vapor phase rust test was run by the revised standard ASTM method D-3603, described fully in Section 5, Volume 05.03, Petroleum Products and Lubricants. The method involves the stirring of a mixture of 275 ml. of the oil under test and 25 ml. of distilled water at a temperature of 60° C. A steel specimen conforming to Grade 1018 of Specification A108:1955-EN313, is located above the liquid under the beaker cover. The test is run for six hours and then the specimen is evaluated.

Test Results:

The steel specimen was completely free of rust. A comparative test run by the same method using FYRQUEL 150 fluid without any additives yielded a panel having heavy rust.

The degree of rust inhibition by contact was demonstrated by immersing a 10.16 cm by 15.24 cm steel paint panel in the rust preventative composition, then allowing the panel to drip dry for several minutes. The coated panel was placed in a shallow pan, covered with water, and the water was allowed to evaporate over several days.

Test Results:

The panel was then evaluated. No rust was observed.

EXAMPLE 2

This example is a comparative experiment to illustrate the rust preventive utility of various ingredients in the composition of the invention.

| | Ingredient | Weight Percent |
|---|---|---|
| Formulation 1 | Fyrquel 150 | 99 |
| | N—methyl-ethanol amine | 1 |
| Formulation 2 | Fyrquel 150 | 100 |

The test method was ASTM D 665 used in the previous example.

| | Ingredient | Amount Gms. | Weight Percent |
|---|---|---|---|
| Formulation 3 | Calcium Petroleum Sulfonate | 1 | .5 |
| | Kerosene | 9 | 4.5 |
| | Fyrquel 150 | 190 | 95 |

Three rust free steel panels were cleaned with naphtha followed by rinsing with methyl alcohol. The panels were dipped into Formulations 1, 2 and 3 and drip dried for 1 minute. Each panel was laid in an aluminum foil dish and covered with 100 ml of distilled water. The condition of the panels was checked when the water evaporated.

Test Results:

| Formulation No. | Condition of Test Panel |
|---|---|
| 1 | Rust |
| 2 | Rust |
| 3 | No Rust |

CONCLUSIONS

The tests illustrate that the aryl phosphate alone does not inhibit rust by vapor or direct contact with metal. Second, use of the vapor phase rust inhibitor as the sole aryl phosphate rust inhibitor is not effective in preventing rust for surfaces contacted. Third, that the formulation according to the claimed invention is effective for rust prevention in both the vapor phase and by direct contact situations.

What is claimed is:

1. A concentrate for imparting rust preventive properties to phosphate ester based functional fluids wherein the concentrate comprises an oil soluble calcium petroleum sulfonate ingredient, a liquid polyolester ingredient, and a vapor phase corrosion inhibiting amount of N-methylethanol amine.

2. An improved rust preventive composition comprising an aryl phosphate ingredient, an oil soluble calcium petroleum sulfonate ingredient and a liquid polyolester ingredient wherein the improvement comprises: a vapor phase corrosion inhibiting amount of N-methylethanol amine.

* * * * *